US012116180B2

(12) United States Patent
Wong et al.

(10) Patent No.: US 12,116,180 B2
(45) Date of Patent: Oct. 15, 2024

(54) STORAGE CONTAINER PROVIDED WITH LID

(71) Applicant: KING'S FLAIR MARKETING LIMITED, Tortola (VG)

(72) Inventors: Siu Wah Wong, Tortola (VG); Tsan Ho Chan, Tortola (VG)

(73) Assignee: KING'S FLAIR MARKETING LIMITED, Tortola (VG)

( * ) Notice: Subject to any disclaimer, the term of this patent is extended or adjusted under 35 U.S.C. 154(b) by 623 days.

(21) Appl. No.: 17/268,785

(22) PCT Filed: Aug. 15, 2019

(86) PCT No.: PCT/IB2019/056922
§ 371 (c)(1),
(2) Date: May 10, 2021

(87) PCT Pub. No.: WO2020/035814
PCT Pub. Date: Feb. 20, 2020

(65) Prior Publication Data

US 2021/0253310 A1 Aug. 19, 2021

Related U.S. Application Data

(60) Provisional application No. 62/833,077, filed on Apr. 12, 2019, provisional application No. 62/764,930, filed on Aug. 16, 2018.

(51) Int. Cl.
*B65D 45/20* (2006.01)
*B65D 51/24* (2006.01)

(52) U.S. Cl.
CPC ..... *B65D 45/20* (2013.01); *B65D 51/242* (2013.01)

(58) Field of Classification Search
CPC ..... B65D 45/20; B65D 51/242; B65D 2251/1075; B65D 43/20; B65D 43/164;
(Continued)

(56) References Cited

U.S. PATENT DOCUMENTS 2,086,534 A * 7/1937 Byrne ..... B65D 43/14 220/811
3,688,942 A 9/1972 Mitchell
(Continued)

FOREIGN PATENT DOCUMENTS

CN 1409680 4/2003
CN 202265057 U 6/2012
(Continued)

*Primary Examiner* — Jeffrey R Allen
(74) *Attorney, Agent, or Firm* — WPAT, PC

(57) ABSTRACT

A container having a container body, with a lid placed thereon, an actuation apparatus for actuating the lid to move between a closed position and a release position. One or more body cam surfaces are arranged on an outer surface of a side wall of the container body, and one or more lid cam surfaces are arranged on an inner surface of a neck portion of the lid in such a manner that the body cam surfaces are configured to oppose the corresponding lid cam surfaces. The lid is locked in the closed position by moving the lid in a first direction so as to bring the lid cam surfaces to abut on and engage with the body cam surfaces, and the lid is moved to the release position by moving the lid in a second direction so as to disengage the lid cam surfaces from the body cam surfaces.

15 Claims, 17 Drawing Sheets

(58) Field of Classification Search
CPC ..... B65D 55/022; B65D 2255/20; Y10T 292/0913
USPC ..... 220/811, 812, 813, 814, 816
See application file for complete search history.

(56) References Cited

U.S. PATENT DOCUMENTS

| | | | | |
|---|---|---|---|---|
| 3,770,156 | A | 11/1973 | Yates | |
| 4,349,121 | A * | 9/1982 | Lafferty | B65D 43/164 220/840 |
| 6,454,115 | B1 | 9/2002 | Allasia | |
| 8,646,648 | B2 | 2/2014 | Gel | |
| 2018/0265267 | A1 * | 9/2018 | Arenas | B65D 45/00 |

FOREIGN PATENT DOCUMENTS

| | | | |
|---|---|---|---|
| CN | 104169184 | A | 11/2014 |
| CN | 204587620 | U | 8/2015 |
| KR | 20050029185 | A | 3/2005 |
| WO | WO0034143 | | 6/2000 |
| WO | WO2017155270 | A1 | 9/2017 |

* cited by examiner

STORAGE CONTAINER PROVIDED WITH LID

FIELD OF THE INVENTION

This non-provisional application claims priorities from U.S. Provisional Application No. 62/764,930, filed on Aug. 16, 2018, and U.S. Provisional Application No. 62/833,077, filed on Apr. 12, 2019, the disclosures of which are incorporated herein by reference in their entirety.

The invention relates generally to the field of storage containers. More specifically, the present invention relates to a storage container provided with a lid, in which the lid and a container body of the container have complementarily interfitting elements to guide the lid to move transversely relative to the container body, thereby enabling easy closing and opening of the container in a sealing manner.

BACKGROUND OF THE INVENTION

Containers generally come with a cover or lid. Some containers for items that need to be kept fresh, such as food, have a lid that can form an air-tight and/or water-tight with the container. This kind of sealing can be achieved by a friction-fit lid. However, both closing and opening of the lid become difficult due to the tight friction between the lid and the container wall. Another way to seal the container with a lid is to provide latches on all four sides of the container. However, the use of the latches not only increases the production cost of the lid, but also involves four latches for closing and opening the lid, so it is troublesome to use and rather difficult to open the container, and a relatively large manual force is required.

U.S. Pat. No. 3,750,822 provides a closure for containers, more specifically for jars, bottles, cans, and the like. Such closure includes a seal press that fits tightly against the inner wall of the container, in which the sealing pressure can be quickly and reliably produced and relieved, thereby making possible a quick operation of the closure.

EP 20080461 also discloses a lid for a storage container, including a button that can be movably carried by the lid, and a seal element carried by the lid and shiftable between a compressed state for sealingly engageable with the container wall structure when the lid is in the closed position and a non-compressed state for disengaging from the wall structure.

Therefore, there is a need for a container lid which can be sealably attached to and removed from the container with ease.

SUMMARY OF THE INVENTION

The present invention has been developed to fulfill the above needs, and therefore has a main object of the provision of a storage container with a lid that can be used to seal the container, and the mechanism for opening and closing the container is easy to manufacture, and simple and effortless to operate.

Another object of the present invention is to provide a storage container having a lid which is easy to open and convenient to clean.

It is still another object of the present invention to provide a storage container having a lid, in which a sealing element can create a good sealing effect under the functioning of the interfitting elements of the lid and the container body which are designed to complementarily interfit with each other.

These and other objects and advantages of the present invention are achieved by providing a storage container according to the present invention, the storage container comprising:

- a container body having a bottom, a side wall extending upwardly from the bottom, an internal storage space surrounded by the side wall, a top edge and an open top defined by the top edge,
- a lid placed on the container body for opening and closing the open top, comprising a plate-shaped portion and a neck portion extending downwardly from at least a part of opposite sides of the plate-shaped portion, and
- an actuating apparatus configured to actuate the lid to move between a closed position where the storage container is closed and a release position where the storage container is ready to open,
- wherein one or more body cam surfaces are arranged on an outer surface of the side wall of the container body at one or more positions adjacent to the open top, and one or more lid cam surfaces are arranged on an inner side surface of the neck portion of the lid in such a manner that the lid cam surfaces are configured to oppose the body cam surfaces respectively, and
- wherein the lid is locked in the closed position by moving the lid in a first direction so as to bring the lid cam surfaces into abutment on and engage with the body cam surfaces, and the lid is moved to the release position by moving the lid in a second direction so as to disengage the lid cam surfaces from the body cam surface.

In a preferred embodiment, the storage container further comprises a handle having a pivot through which the handle is pivotally mounted on the lid, and the actuating apparatus is configured as a gear rack and pinion mechanism, the gear rack and pinion mechanism comprising:

- a gear rack arranged on a flange of the side wall of the container body, and
- at least one gear portion engageable with the gear rack, wherein the gear portion is connected to the pivot of the handle and defines a plurality of pinions,
- wherein pivotal movement of the handle relative to the lid drives the gear portion to rotate so that the plurality of pinions alternately engage with the gear rack, thereby moving the lid to cause the lid cam surfaces to engage with or disengage from the respective body cam surfaces.

Preferably, the gear portion may comprise a base, the base comprising a plate element having a first end which extends transversely from the pivot of the handle, and a second end from which the plurality of pinions extend downwardly. The neck portion of the lid may comprise a cutout to allow passing of the pivot of the handle therethrough, the pivot being held pivotally in place. In some cases, the container body further comprises one or more guiding protrusions on a same side of the body cam surfaces to guide positioning of the lid relative to the container body and guide the lid to move between the closed position and the release position.

In another preferred embodiment, the actuating apparatus is configured as a locking flap foldably or pivotally connected to the container body, and the locking flap defines a locked position where the lid is locked by the locking flap in the closed position, and an unlocked position where the lid is releasable to the release position.

In a specific embodiment, the locking flap is foldably or pivotally connected to the side wall of the container body, the locking flap having a first end portion provided with a snap-fit projection. The plate-shaped portion of the lid together with a portion of a lip extending downwardly from the plate-shaped portion define a snap-fit groove, wherein the snap-fit projection is engageable with the snap-fit groove when the locking flap is folded or pivots downwardly into the locked position, and is disengageable from the snap-fit groove when the locking flap is folded or pivots upwardly into the unlocked position.

In another specific embodiment, the locking flap is foldably or pivotally connected to a connecting portion extending upwardly from the top edge of the container body, the locking flap having at least one snap-fit projection in operative cooperation with an snap-fit groove formed on the plate-shaped portion of the lid, wherein the snap-fit projection is configured to come into contact with the snap-fit groove to drive the lid to move to the closed position in the first direction during the process of folding or pivoting the locking flap downwardly to the locked position, and also come into contact with the snap-fit groove to drive the lid to move to the release position in the second direction during the process of folding or pivoting the locking flap upwardly to the unlocked position. The locking flap comprises a plate-like piece foldably or pivotally connected to the connecting portion, and a L-shaped element extending downwardly from the plate-like piece, wherein the plate-like piece, the L-shaped element, and the connecting portion form together a channel for receiving an inwardly recessed portion of the lid, and wherein the snap-fit projection is arranged at a bottom of the L-shaped element.

According to a preferred embodiment of the present invention, the lid has a pivotal side detachably pivotal on the container body and an implementing side opposite to the pivotal side. The pivotal side of the lid comprises a downwardly extending portion having an inverted T shape, the downwardly extending portion comprising an upright element and a transverse element transversely extending from the upright element, wherein a pivotal point forms outwardly at each of two opposite ends of the transverse element; and two lugs in spaced-apart fashion are formed on one side wall of the container body, each lug having a slot therein, wherein the two lugs are positioned such that the two pivotal points of the downwardly extending portion are movably received in the respective slots. The slot may be L-shaped, comprising a horizontal slot portion and a vertical slot portion, and the pivotal point is movable in the horizontal slot portion between a distal end in communication with the vertical slot portion and a proximal end away from the vertical slot portion. The lid is detachable from the container body when the pivotal point is positioned at the distal end, and locked to the container body to close the open top when the pivotal point is positioned at the proximal end.

In another specific embodiment, one or more spaced-apart tabs extending downwardly from the lid are provided on the implementing side of the lid, each of the tabs having a hook member at a free end thereof. A flange is formed on the side wall of the container body, and one or more through holes are positioned on the flange. The through holes are sized and positioned so that the respective tabs are detachably and movably received in the through holes, or vice versa, that is, one or more of the through holes are formed on the implementing side of the lid, and one or more of the tabs are provided on the side wall of the container body. Preferably, the through hole is provided as a stepped hole for engagement with the hook member when it moves in the stepped hole to a position away from the container body so as to lock the lid in the closed position, and the hook member disengages from the stepped hole when it moves in the stepped hole to a position adjacent to the container body so as to render the lid in the release position.

In order for an aesthetic and pleasing appearance of the storage container, the handle is configured to rest on the implementing side of the lid in the closed position, and the pivotal side of the lid is provided with a side rim surrounding the pivotal side. The side rim and the handle are structured and sized to be complementary to each other in a manner that they form together an annular ring that snaps fit into the outer circumferential edge of the lid.

In order to create a better sealing effect, the storage container may further comprise a seal element which may be provided as a seal ring in a specific embodiment, and also a seal assembly in other forms. Preferably, the seal ring may be arranged in an annular groove of the lid, and the lid cam surfaces are brought into abutment on and engagement with the body cam surfaces to bias the seal ring against the inner wall of the container body, thereby creating a seal between the container body and the lid. The seal ring is released when the lid cam surfaces are disengaged from the body cam surfaces.

Other objects, features, technical effects and advantages of the present invention will be apparent from the following detailed description in conjunction with the accompanying drawings.

BRIEF DESCRIPTION OF THE DRAWING

In the various figures of the drawings, like reference numbers are used to designate like parts for the sake of clarity.

DETAILED DESCRIPTION OF THE INVENTION

While this invention is illustrated and described in preferred embodiments, the storage container of the invention may be produced in many different configurations, sizes, forms and materials.

Figure 1:
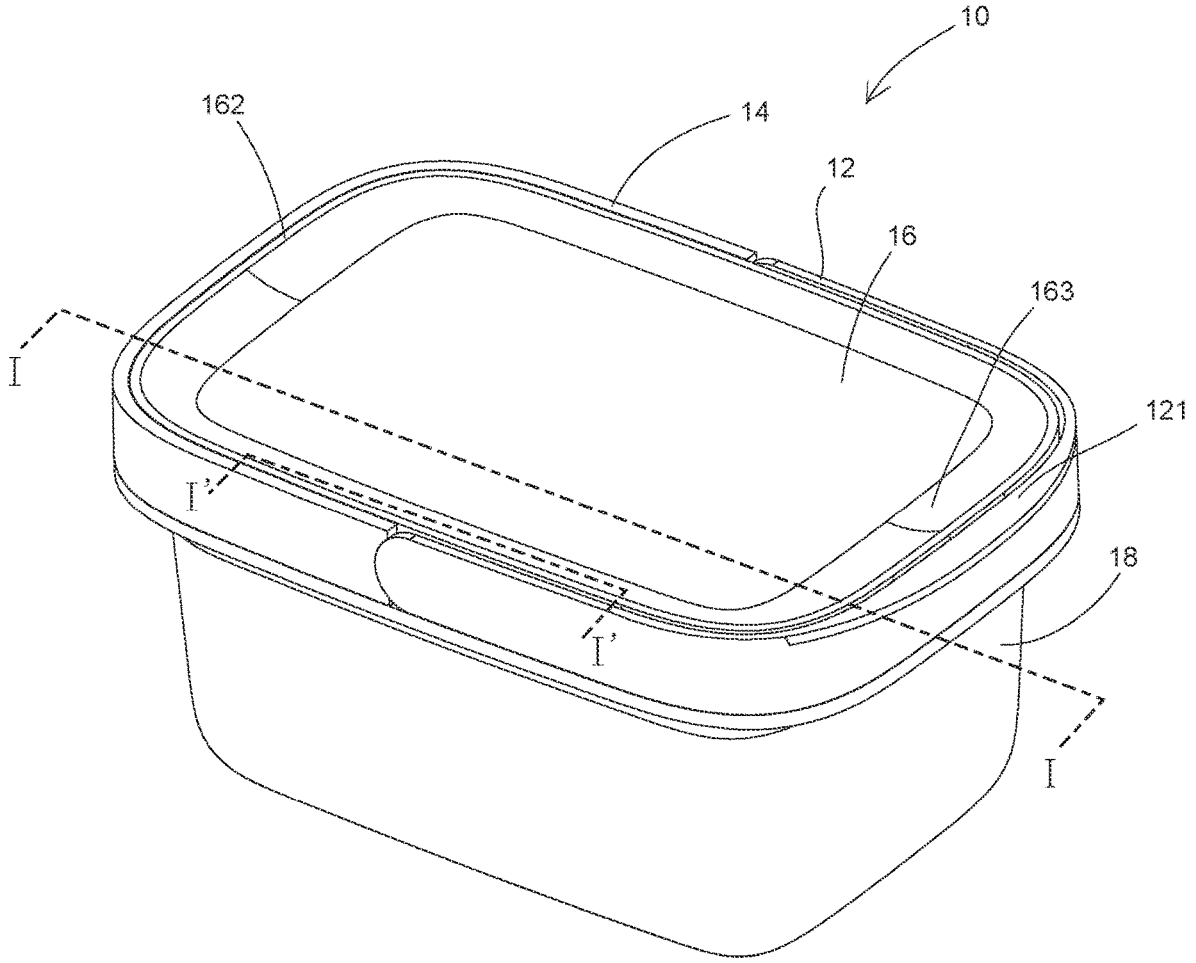
FIG. 1 is a perspective view of a storage container constructed according to a first embodiment of the present invention, wherein the container is in a hermetically closed state.
Figure 2:
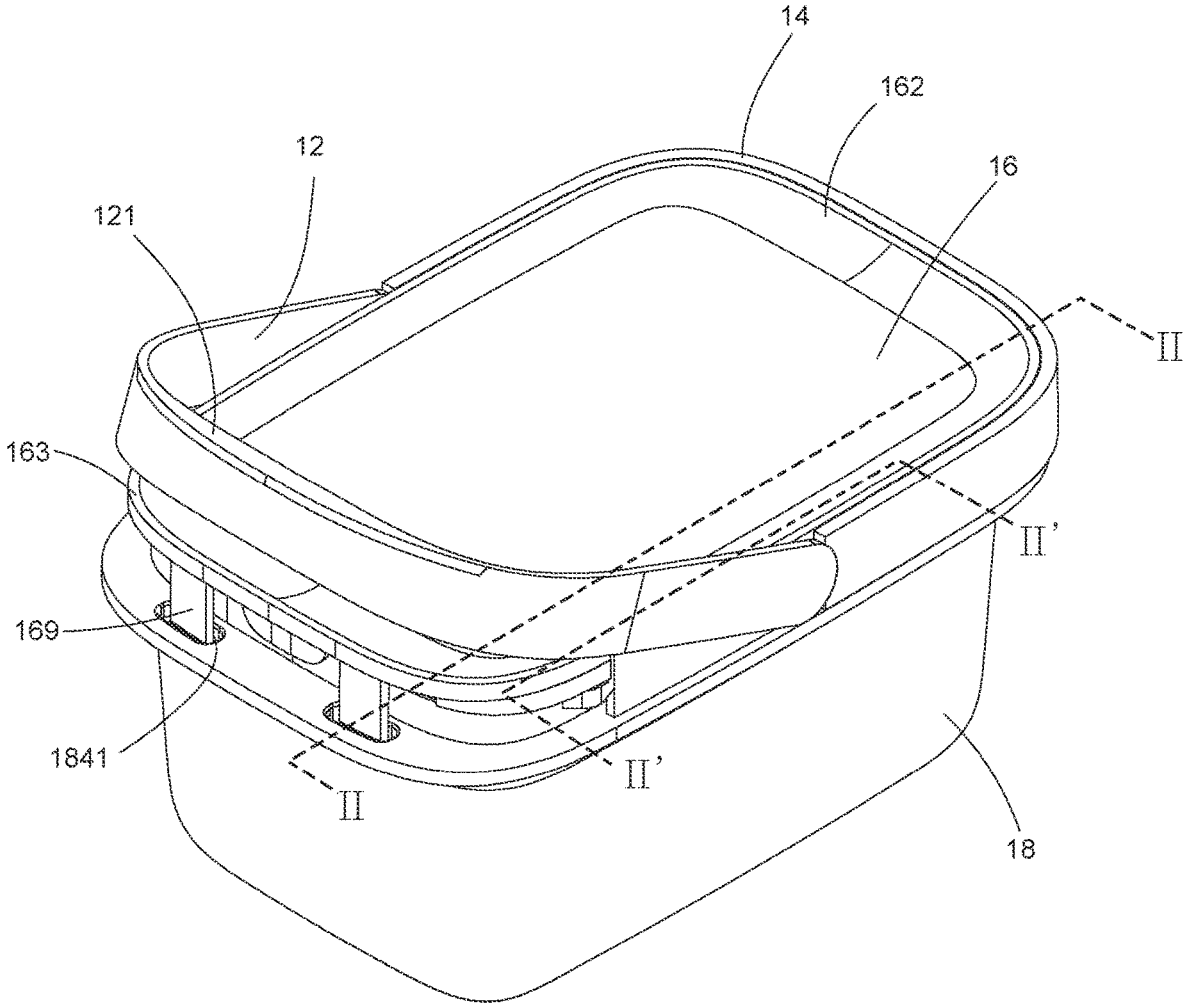
FIG. 2 is a perspective view of the storage container shown in FIG. 1 with a lid placed on a container body, wherein the storage container is in a ready to open state.
Figure 3:
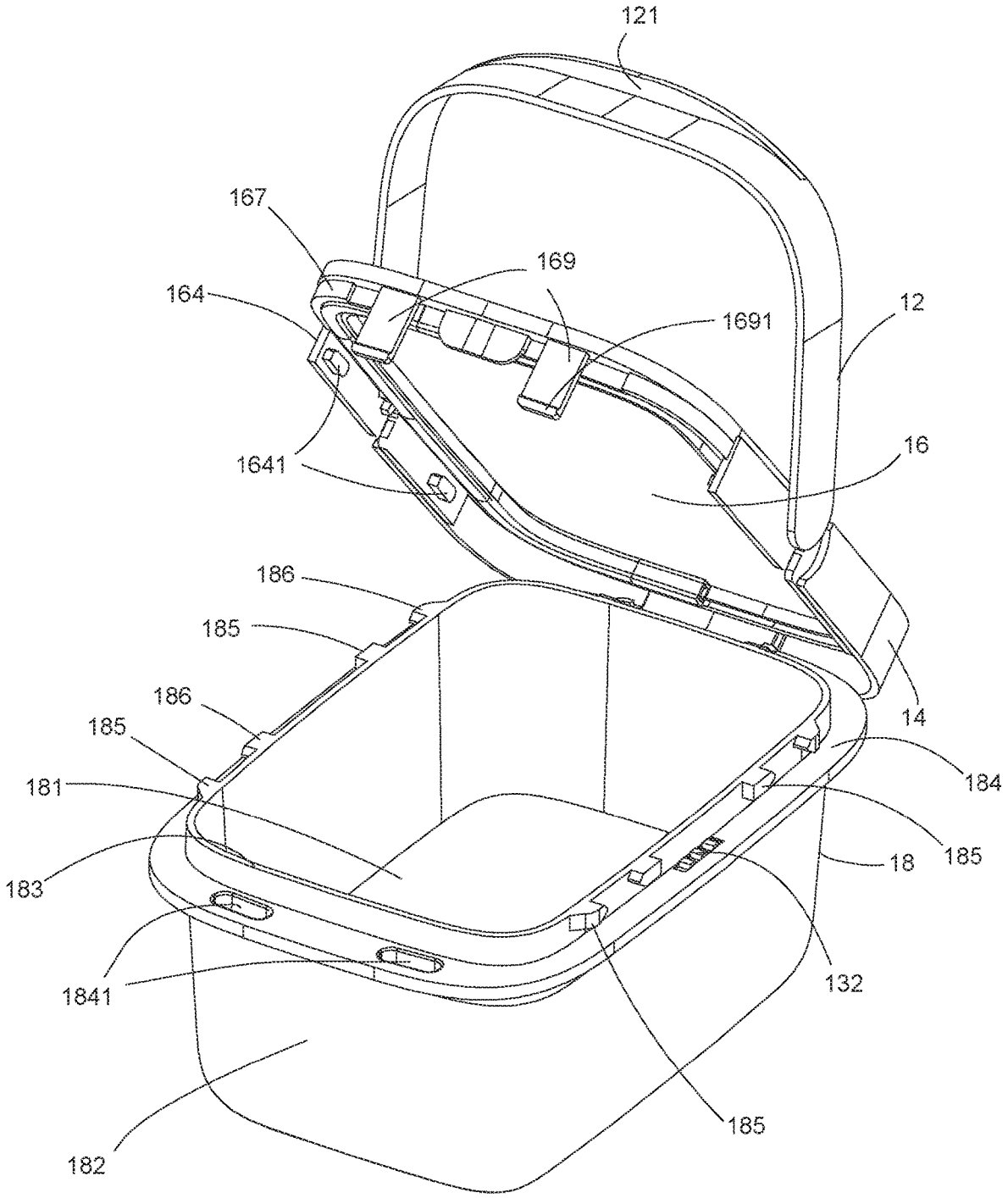
FIG. 3 is a perspective view of the storage container shown in FIG. 1, wherein the storage container is in an open state.

Referring now to the drawings, FIGS. 1 to 15 illustrate a storage container 10 constructed in accordance with a first preferred embodiment of the present invention. As shown in FIGS. 1 to 3, the storage container 10 comprises a container body 18 and a lid 16 placed over the container body 18 to close or open the container body 18. The lid 16 has a pivotal side 162 and an implementing side 163 opposite to the pivotal side. The container body 18 and the lid 16 substantially have a shape similar to a cubic shape or a rectangular cylindrical shape as shown. Other shapes and structures, such as shapes of sphere or circle, are possible for the container body 18 and the lid 16 of the present invention and fall within the scope of the present invention. The present invention is not limited to a particular container body and a particular peripheral shape or a particular overall contour of the lid.

Figure 4:
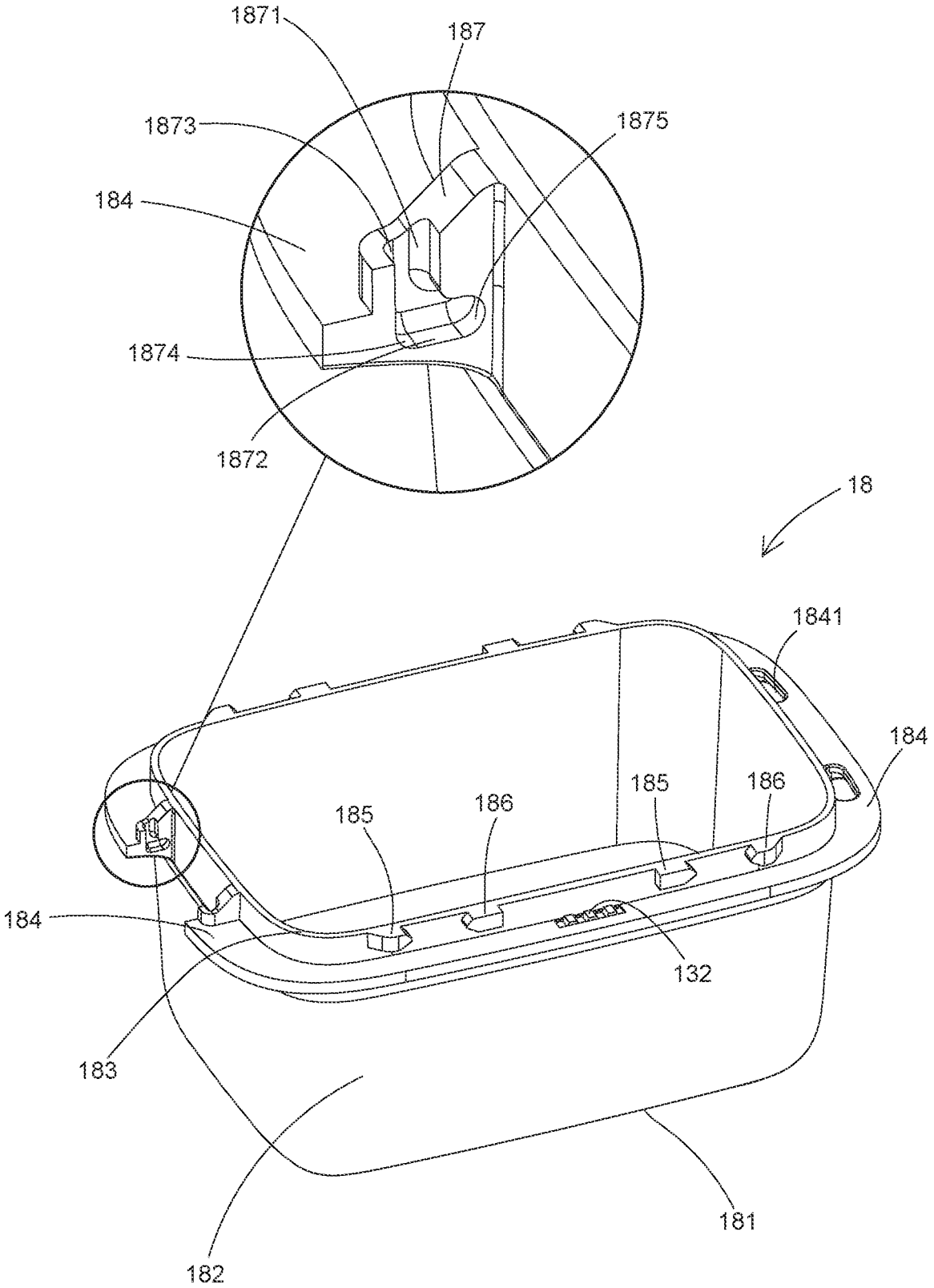
FIG. 4 is a perspective view of the container body of the storage container shown in FIG. 1.
Figure 5:
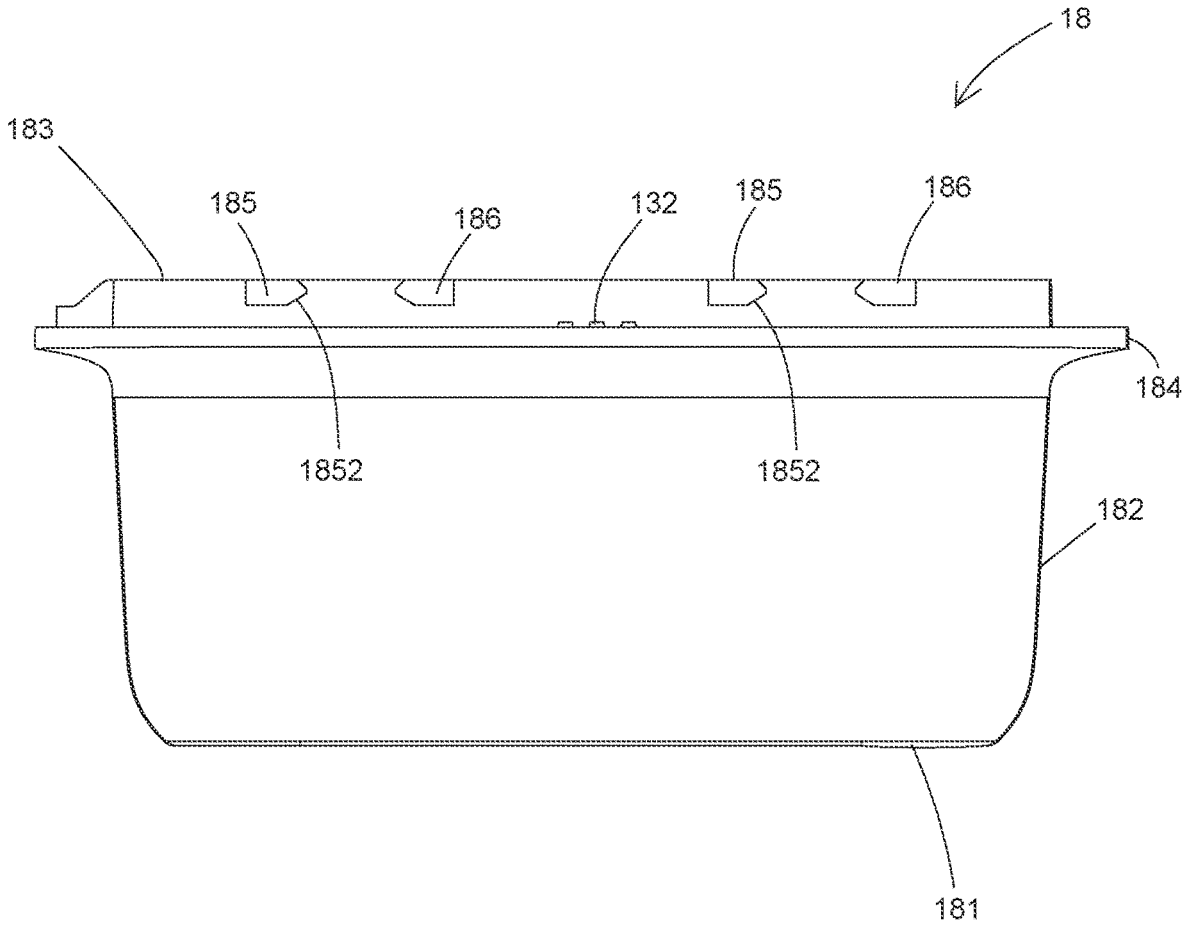
FIG. 5 is a front view of the container body of the storage container shown in FIG. 1.

FIGS. 3 to 5 show the structural details of the container body 18. The container body 18 has a bottom 181, a continuous side wall 182 extending upwardly from the bottom, an internal storage space surrounded by the side wall 182, a top edge 183 and an open top defined by the top edge 183. In this embodiment, the side wall 182 and the bottom 181 are substantially rectangular.

FIGS. 4 and 5 are the container body 18 in perspective view and in front elevation view, respectively. The container body 18 comprises a flange 184 formed on the side wall 182 adjacent to the top edge 183, and a gear rack 132 is arranged on the flange 184. The gear rack 132 is provided to cooperate with a gear portion 131 discussed herein below. The gear rack 132 and the gear portion 131 constitute a gear rack and pinion mechanism of the present invention useful as an actuating apparatus for actuating the lid 16 to pivot between a closed position where the container 10 is closed and a release position where the container 10 is to be opened.

Four protrusions 185 are arranged above the flange 184 on opposite sides of the rectangular cylindrical container body, each side having two of the protrusions 185. A side surface of each of the protrusions 185 facing the bottom 181 of the container body forms a body cam surface 1852. In the illustrated container body, two spaced-apart protrusions 185 having a respective body cam surface 1852 are arranged on a side wall of one side of the container body. It would be conceivable to have one or more protrusions 185 having a respective body cam surface 1852 on the side wall of the container body. In addition, a guiding protrusion 186 is arranged for each of the protrusions 185 on the same side of the corresponding protrusion 185 and is level with the corresponding protrusion 185 to guide the positioning of the lid 16 relative to the container body 18 and also guide the movement of the lid 16 relative to the container body 18.

Referring again to FIG. 4, two lugs 187 in spaced-apart fashion are formed on a side of the container body 18 corresponding to the pivotal side 162 of the lid 16, and the lugs 187 are arranged on the flange 184. Each of the lugs 187 comprises a slot 1871 therein. The slot 1871 is provided as a L-shaped slot, comprising a horizontal slot portion 1872 and a vertical slot portion 1873. Two spaced-apart through holes 1841 are formed on a side of the container body corresponding to the implementing side 163 of the lid 16, and the through holes 1841 are arranged on the flange 184. In this embodiment, each of the through holes 1841 is provided as a stepped hole having a lower hole portion and an upper hole portion having a dimension smaller than the lower hole portion so as to form a step 1842.

Figure 7:
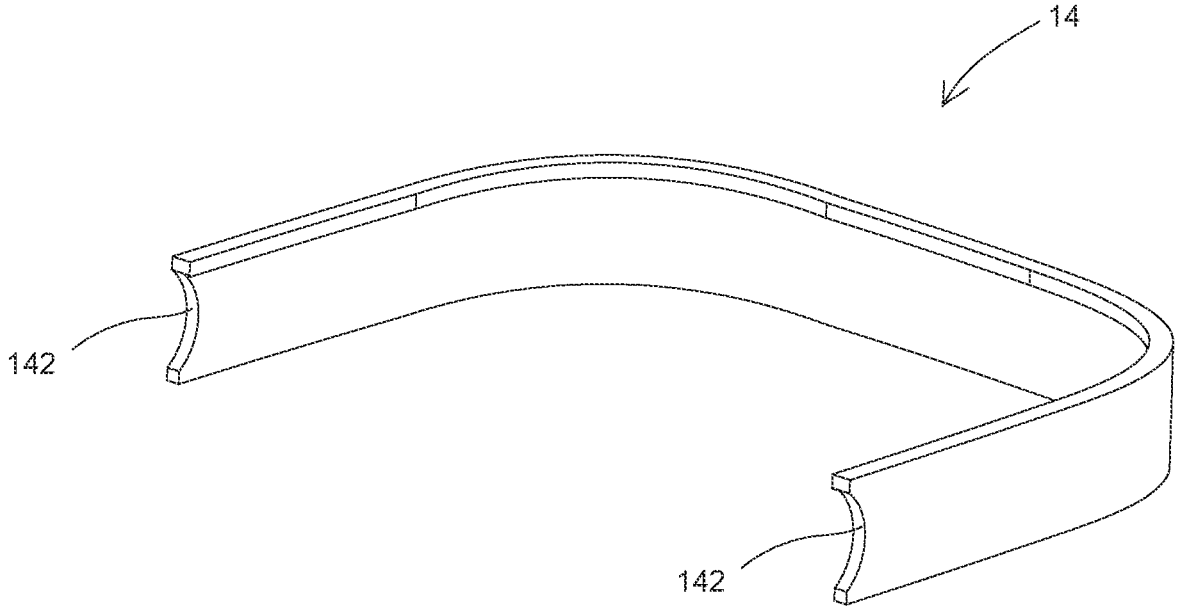
FIG. 7 is a perspective view of a side rim of the lid complementary to the handle shown in FIG. 6.
Figure 9:
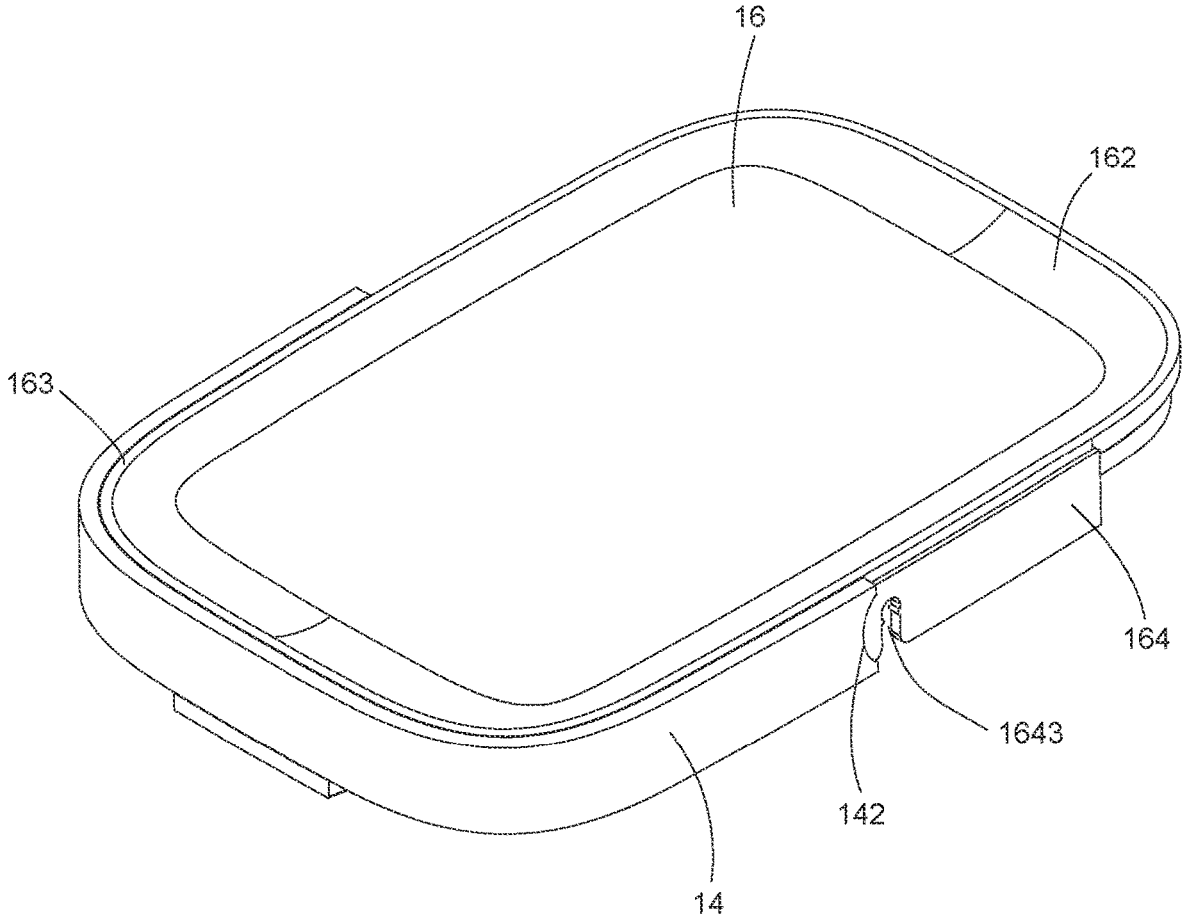
FIG. 9 is a perspective view of the lid shown in FIG. 1, wherein the handle and the side rim together form an annular ring that snaps fit into the outer peripheral edge of the lid.
Figure 10A:
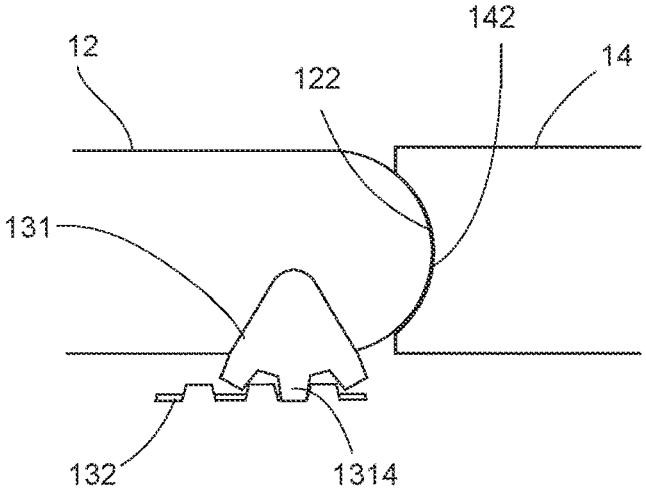
FIG. 10A is a schematic view of an exemplary gear rack and pinion mechanism when the storage container shown in FIG. 1 is in a hermetically closed state.
Figure 10B:
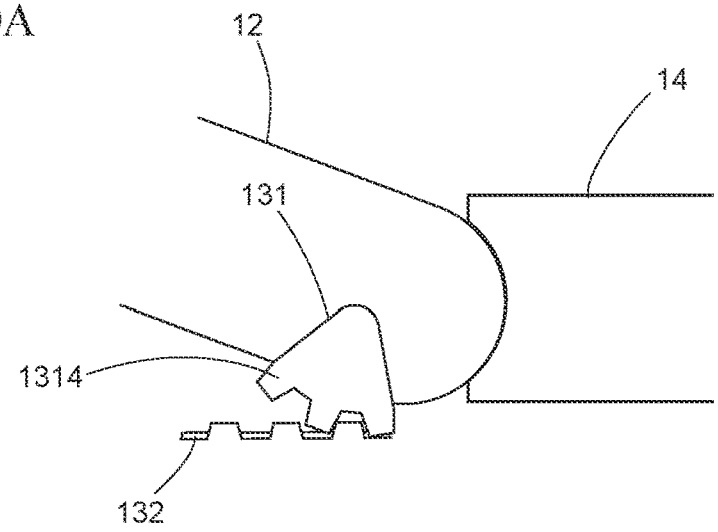
FIG. 10B is a schematic view of the gear rack and pinion mechanism when the storage container shown in FIG. 2 is in a ready to open state.

The pivotal side 162 of the lid 16 is pivotably mounted on the top edge 183 (see FIG. 3) at one side of the container body 18 in a detachable manner, so that the lid 16 is pivotal relative to the container body 18 between a closed position where the lid 16 is coupled with the container body 18 to close the open top of the container body 18, and a release position where the lid 16 pivots away from the container body 18 to expose the open top. The pivotal side of the lid is further provided with a side rim 14 surrounding the pivotal side 162. In this embodiment, the side rim 14 is a U-shaped element having two ends 142 and is fixedly mounted on the pivotal side 162 of the lid 16, as shown in FIGS. 7 and 9.

Figure 6:
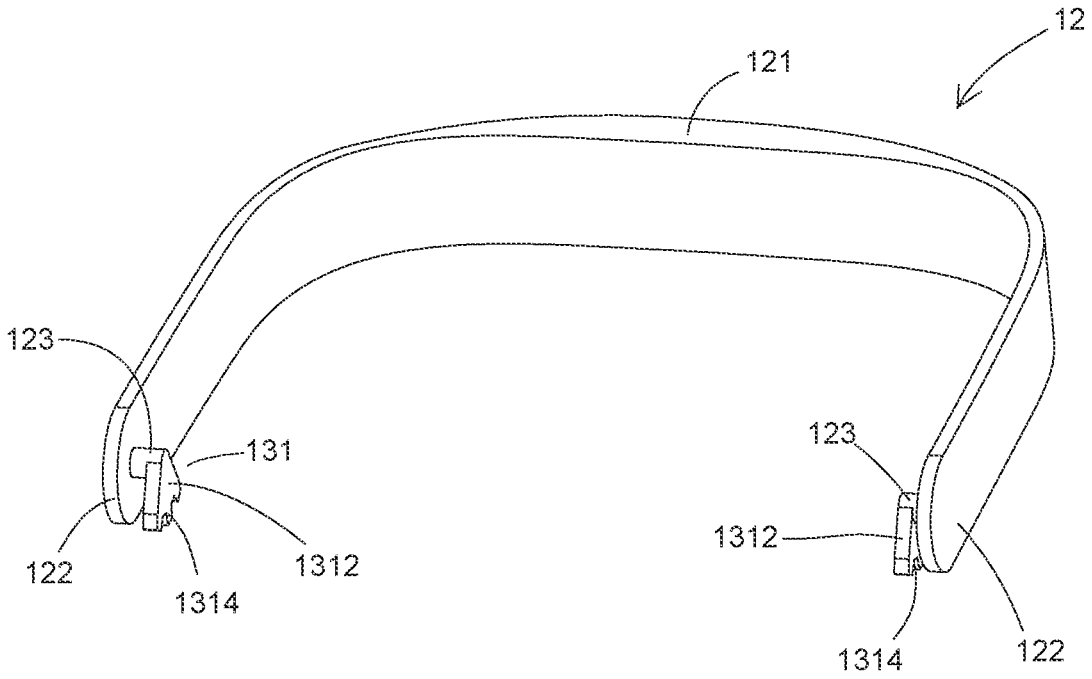
FIG. 6 is a perspective view of a handle of the storage container shown in FIG. 1.

The storage container 10 comprises a handle 12 pivotally mounted on the lid 16, and the handle 12 rests on the implementing side 163 of the lid 16 when the storage container 10 is in a closed state. The handle 12 has a grasping piece 121 protruded outwardly from a portion thereof for providing ease of pivoting the handle to implement the opening and closing of the container body 18. As shown in FIG. 6, the handle 12 is also formed as a U-shaped element having two ends 122. A pivot 123 is arranged on an inner side surface of each end 122 of the handle 12, the pivot 123 having one end fixed to the inner side surface of the end 122 for pivotally coupling the handle 12 to the lid 16, which will be discussed in detail below. The other end of the pivot 123 is transversely connected to the gear portion 131 of the gear rack and pinion mechanism, and the gear portion 131 comprises a substantially triangular base 1312 and a plurality of pinions 1314 extending from an underside of the triangular base 1312. The illustrated gear portion comprises three pinions. The gear portion 131 is in cooperation with the gear rack 132 arranged on the flange 184 of the container body 18, both of which constitute a gear rack and pinion mechanism useful as an actuating apparatus for actuating the lid 16 to pivot between its closed position and its release position. The pivotal movement of the handle 12 relative to the lid enables to drive the gear portion 131 to rotate, so that the three pinions 1314 alternately engage with the gear rack 132 to drive the lid to move, which in turn causes the lid cam surfaces to engage with or disengage from the body cam surfaces. This will also be discussed below. Although the gear rack and pinion mechanism in the illustrated embodiment comprises three triangular pinions 1314 that alternately engage with the gear rack, it would be understood that the gear rack and pinion mechanism may be configured to comprise two or more than four pinions which may have other shapes according to the actual needs.

The handle 12 and the side rim 14 are structured and sized to be complementary to each other, especially the two ends 142 of the side rim 14 and the two ends 122 of the handle 12 are complementary in shape to each other, in a manner that the side rim 14 and the handle 12 together form an annular ring that snugly snaps fit into the outer peripheral edge of the lid (see FIG. 1). The annular ring of this structure not only renders the storage container 10 to have a pleasing appearance, but also provides protection for various structural components enclosed by the annular ring.

Figure 8A:
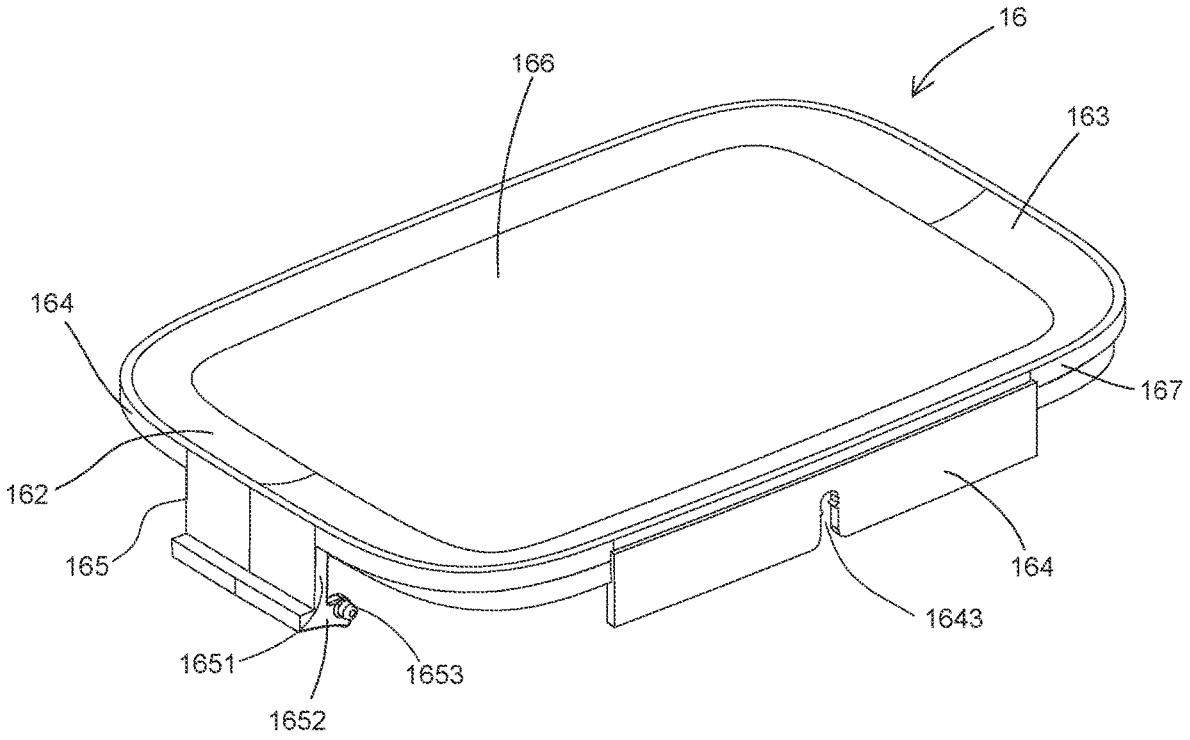
FIG. 8A is a perspective top view of the lid of the storage container shown in FIG. 1.
Figure 8B:
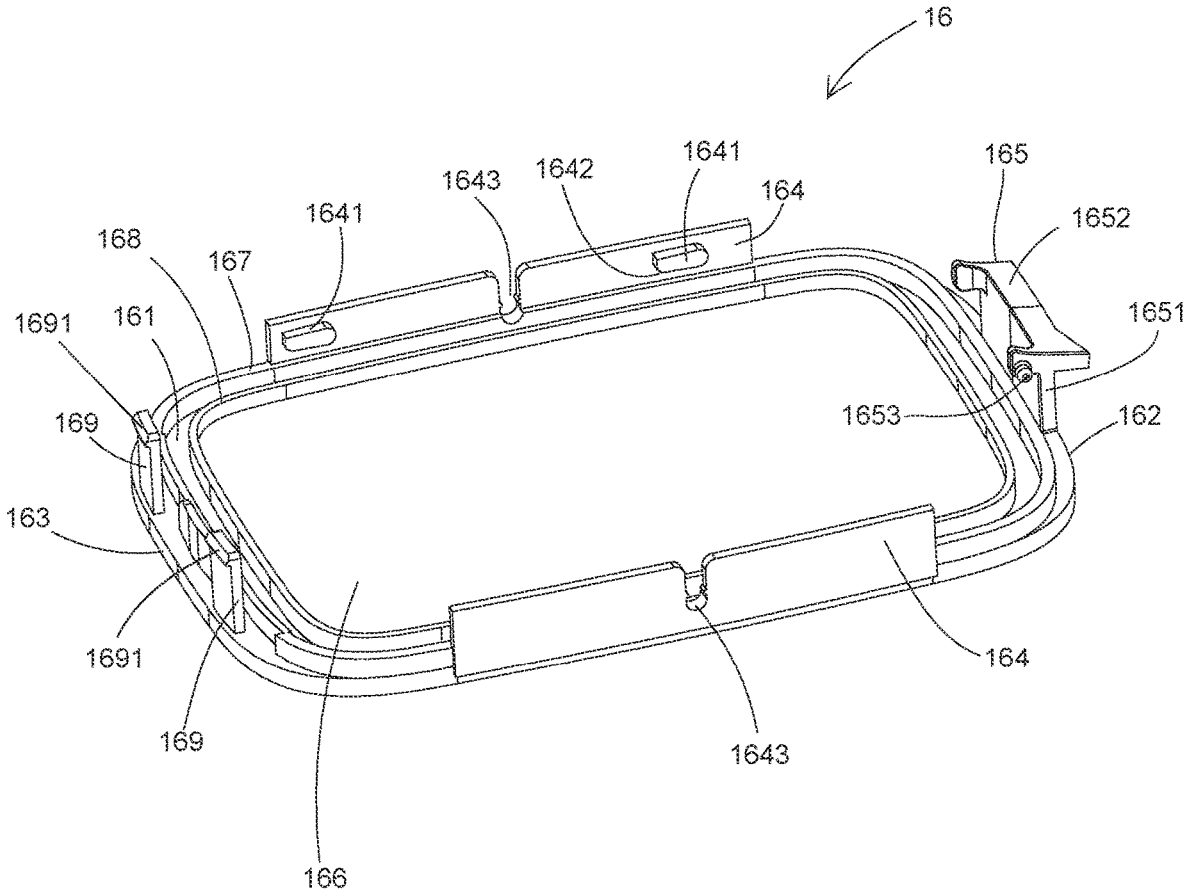
FIG. 8B is a perspective bottom view of the lid of the storage container shown in FIG. 1.
Figure 14:
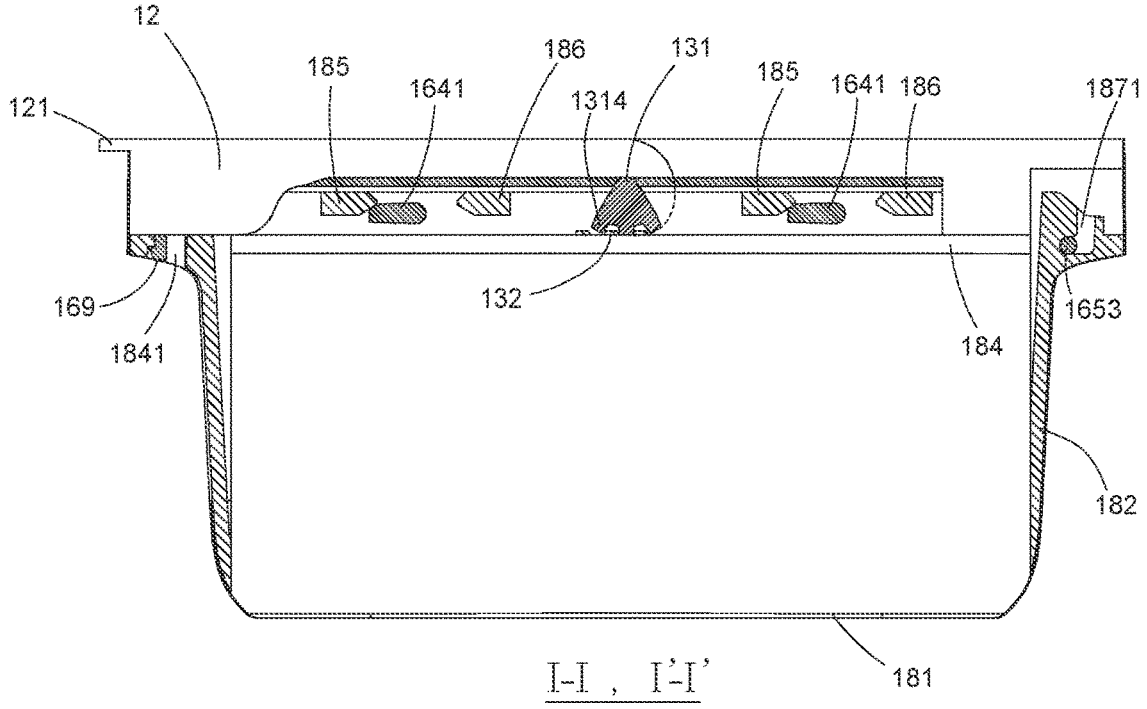
FIG. 14 is a cross sectional view taken along lines I-I and I'-I' of FIG. 1.
Figure 15:
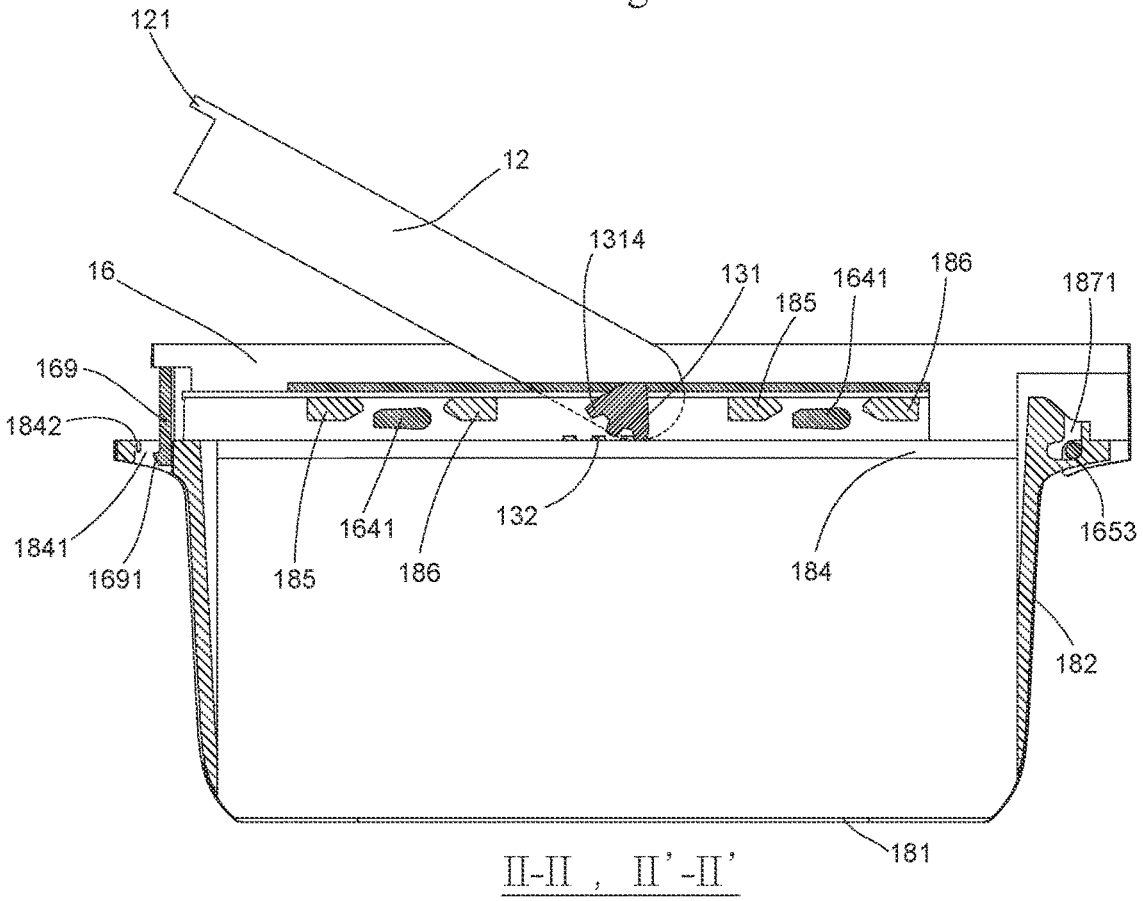
FIG. 15 is a cross sectional view taken along line II-II and II'-II' of FIG. 2.

FIGS. 8A and 8B show the structural details of the lid 16. The lid 16 comprises a plate-shaped portion 166, an outer lip 167 and an inner lip 168 extending downwardly along the periphery of the plate-shaped portion 166, and two neck portions 164 extending downwardly from a portion of the outer lip 167 on the opposite sides of the plate-shaped portion 166. There is a gap between the outer lip 167 and the inner lip 168 to define an annular groove 161 for receiving a seal element. As illustrated, the neck portions 164 extend from the two sides of the lid in correspondence to the two sides of the container body 18 where the protrusions 185 are located. Two bulges 1641 are formed on an inner side surface of each neck portion 164, and have a respective side surface which faces the plate-shaped portion 166 and which is configured to form a lid cam surface 1642. The lid cam surface 1642 is arranged on the inner side surface of the neck portion 164 in such a manner that the lid cam surface 1642 is configured to oppose the corresponding body cam surface 1852. When the lid 16 moves in the first direction, for example, moves transversely toward the left direction shown in FIG. 14, the lid cam surface 1642 is driven to move transversely in the left direction to abut against and engage with the corresponding body cam surface 1852, so that the lid 16 is locked in the closed position, as shown in FIG. 14. When the lid 16 moves in the second direction, for example, moves transversely toward the right direction shown in FIG. 14, the lid cam surface 1642 is driven to move transversely in the right direction to disengage from the body cam surface 1852, so that the lid moves into its release position, as shown in FIG. 15.

The body cam surface 1852 of the container body 18 and the corresponding lid cam surface 1642 of the lid 16 are configured to oppose to each other in a manner so that they are shaped and positioned to correspond to and be engageable with each other. In some cases, the body cam surface 1852 and the lid cam surface 1642 are shaped as opposite inclined surfaces, so that they are easily engageable with each other during the movement thereof.

When the lid 16 is in the closed position, a seal element (not shown) received in the annular groove 161 is biased against the container body 18 to create a seal between the lid 16 and the container body 18. The seal element located between the lid 16 and the container body 18 helps to preserve items such as food stored in the container body 18. When the lid 16 is in the release position, the seal element in the annular groove 161 is released to resume to its original loose and unpressed state where the lid 16 is easily removed from the container body 18 to access the items stored in the container.

In the embodiment as illustrated, two bulges 1641 having a respective lid cam surface 1642 are arranged on the lid 16. It would be appreciated that the number of the bulges 1641 with their respective lid cam surfaces 1642 corresponds to the number of the protrusions 185 of the container body with their respective cam surfaces 1852.

Turning back to FIGS. 8A and 8B, each neck portion 164 in this embodiment comprises a cutout 1643 which is substantially arranged in the middle of the neck portion 164 to allow passing of the pivot 123 of the handle 12 precisely therethrough and to pivotally holds the pivot 123 in place. The annular ring formed by the side rim 14 and the handle 12 covers up the cutout 1643, and at the same time protects the pivot 123 and the gear portion 131 enclosed by the annular ring.

The pivotal side 162 of the lid comprises a downwardly extending portion 165, at least a portion of which is configured to be pivotably insertable into the two lugs 187 of the container body 18, whereby the lid 16 is pivotably mounted on one side of the container body 18 in a detachable manner. As shown in FIG. 8A, the downwardly extending portion 165 in this embodiment has an inverted T shape, comprising an upright element 1651 and a transverse element 1652. The opposite ends of the transverse element 1652 extends outwardly to form two pivotal points 1653. The two pivotal points 1653 are movably received in the respective slots 1871 of the lugs 187, so that the lid 16 is pivotably mounted on the container body 18.

As described above, the slot 1871 is L-shaped, and comprises the horizontal slot portion 1872 and the vertical slot portion 1873. Each of the two pivotal point 1653 of the downwardly extending portion 165 is movably received within the horizontal slot portion 1872 between a distal end 1874 of the horizontal slot portion 1872 which is in communication with the vertical slot portion 1873, and a proximal end 1875 of the horizontal slot portion 1872 which is away from the vertical slot portion 1872. When the pivotal point 1653 of the downwardly extending portion 165 moves to the distal end 1874, the lid 16 is in the release position where the lid 16 can be separated from the container body 18. When the pivotal point 1653 of the downwardly extending portion 165 moves to the proximal end 1875, the lid is in the closed position where the lid is hermetically locked onto the container body 18.

The implementing side 163 of the lid comprises a pair of spaced-apart tabs 169 extending downwardly from the lid 16, each of the tabs 169 having a hook element 1691 protruding outwardly at a free end thereof. The pair of tabs 169 is positioned to correspond to the two spaced-apart stepped through holes 1841 arranged on the container body 18, so that the tabs 169 are detachably and movably received in the respective through holes 1841. Specifically, the hook element 1691 of the tab 169 is movably received in the lower hole portion of the stepped through hole 1841 and engageable with the step 1842 of the through hole 1841 when the hook element 1691 received in the lower hole portion of the through hole 1841 moves to a position away from the container body 18, thereby to lock the lid 16 to the closed position where the lid is locked to the container body 18. The hook element 1691 of the tab 169 is disengageable from the step 1842 of the through hole 1841 when the hook element

1691 received in the lower hole portion of the through hole 1841 moves to a position close to the container body 18, thereby to release the lid 16 into the release position where the lid is ready for separation from the container body 18.

In a variation of positioning the tabs 169 and the through holes 1841, the pair of tabs may be formed on the edge of the container body 18, and the stepped through holes or the stepped grooves may be positioned on the implementing side 163 of the lid 16. Such a variation can achieve the same function.

FIGS. 10A to 13B and FIGS. 14 and 15 are schematic views showing the positions of the relevant parts when the container body 18 is in the hermetically closed state and in the ready to open state, respectively. An exemplary mechanism useful to hermetically closing and opening the storage container 10 is described in detail below with reference to FIGS. 10A to 13B and FIGS. 14 and 15.

First, the two pivotal points 1653 of the downwardly extending portion 165 of the lid 16 are inserted into the slots 1871 of the two lugs 187 of the container body 18, so that the downwardly extending portion 165 of the lid 16 is pivotally connected to the two lugs 187 of the container body 18, as shown in FIG. 3.

Figure 11A:
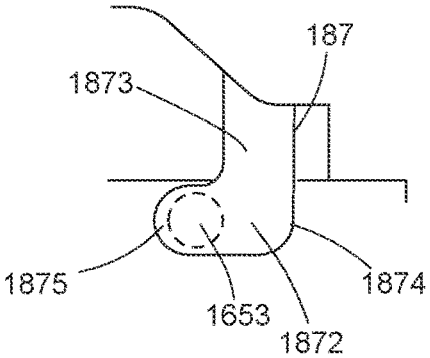
FIG. 11A is a schematic view of a pivotal point positioned in the slot of the lug in correspondence to FIG. 10A.
Figure 11B:
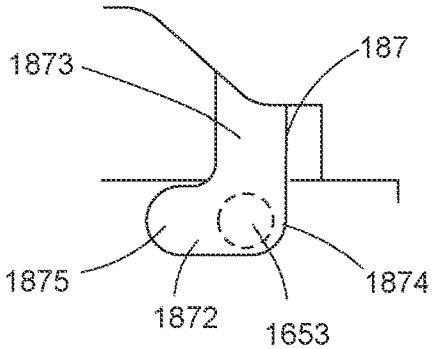
FIG. 11B is a schematic view of the pivotal point positioned in the slot of the lug in correspondence to FIG. 10B.
Figure 12A:
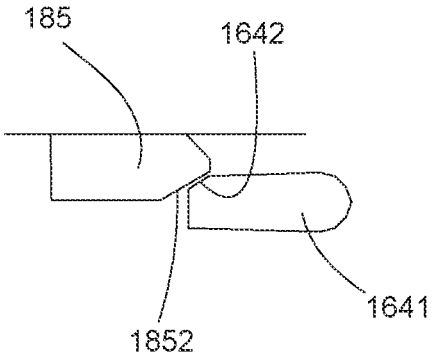
FIG. 12A is a schematic view of a body cam surface engaged with a corresponding lid cam surface in correspondence to FIG. 10A.
Figure 12B:
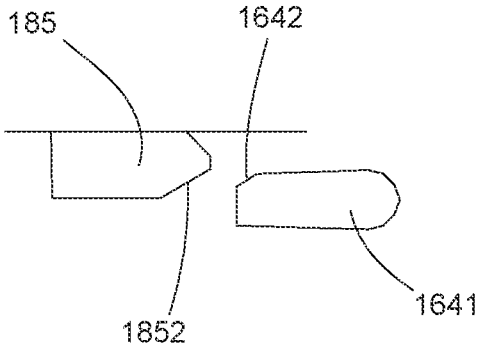
FIG. 12B is a schematic view of the body cam surface disengaged from the corresponding lid cam surface in correspondence to FIG. 10B.
Figure 13A:
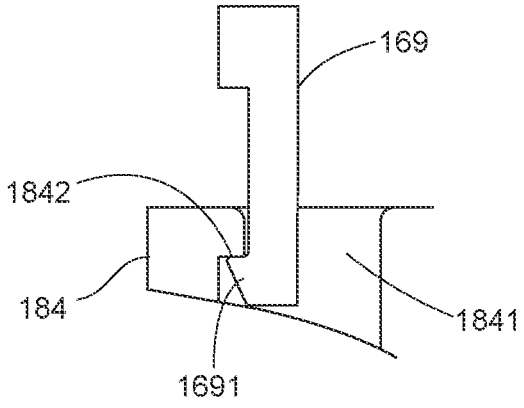
FIG. 13A is a schematic view of a hook element positioned in the stepped hole in correspondence to FIG. 10A.
Figure 13B:
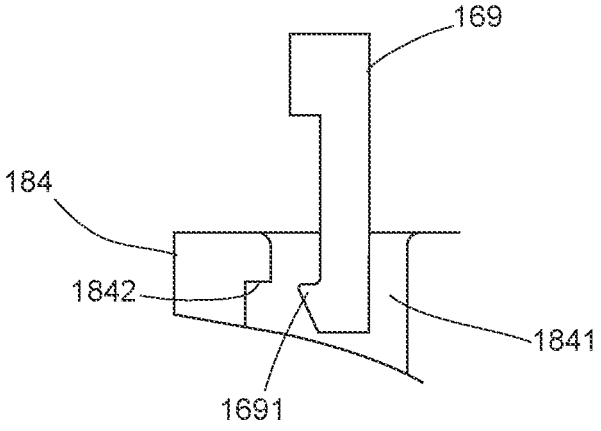
FIG. 13B is a schematic view of the hook element positioned in the stepped hole in correspondence to FIG. 10B.

Next, the lid 16 pivots downwardly relative to the container body 18 to cover the open top of the container body 18, where the storage container is in an unsealed and ready to open state as shown in FIG. 2. Referring now to FIG. 11B, the pivotal point 1653 of the downwardly extending portion 165 is located at the distal end 1874 of the slot 1871 to be in communication with the vertical slot portion 1873, therefore the downwardly extending portion 165 is allowed to disengage from the slot 1871 and thus allow for releasing or separation of the lid 16 from the container body 18, that is, the lid is in the release position. Referring now to FIG. 15, the handle 12 is pressed down toward the lid 16, enabling to pivot the handle 12 downwardly relative to the lid until it fully rests on the implementing side 163 of the lid, as shown in FIG. 14. This downward pivotal movement of the handle 12 drives rotation of the gear portions 131 arranged at both ends thereof toward the implementing side 163 of the lid, so that the middle pinion of the three pinions 1314 is engaged with the gear rack 132 arranged on the flange 184 of the container body 18 (see FIG. 10A), which in turn causes the lid 16 to move transversely in the direction toward the implementing side 163 thereof. This transverse movement of the lid 16 results in movement of the bulge 1641 of the lid toward the protrusion 185 of the container body until the lid cam surface 1642 on the bulge 1641 is brought into abutment on and engages with the body cam surface 1852 of the protrusion 185 (see FIG. 12A) to lock the lid 16 in the closed position. Under the condition that the lid cam surface 1642 is engaged with the body cam surface 1852, the seal element received within the annular groove 161 of the lid 16 is biased to circumferentially deform and press against the inner side surface of the side wall 182 of the container body 18, so that the lid 16 and the container body 18 are tightly abutted to form a sealed closure. At the same time, each of the two pivotal points 1653 of the downwardly extending portion 165 of the lid 16 moves within the slot 1871 of the lugs 187 of the container body 18 away from the distal end 1874 of the slot 1871 and reaches the proximal end 1875 (see FIG. 11A). In addition, the hook element 1691 of the tab 169 of the lid moves in the through hole 1841 of the container body 18 in the direction toward the container body 18 until it engages with the step 1842 (see FIG. 13A). Therefore, the seal element is biased to press and deform so that the lid 16 is urged into tight abutment with the container body 18, thereby achieving a hermetical closing of the storage container 10.

When it is needed for opening the lid 16 to store and access the items in the storage container 18, the handle 12 of the storage container in the hermetically closed state (see FIG. 14) pivots upwardly relative to the lid 16 by manipulating the grasping piece 121 of the handle 12 (see FIG. 15), and the storage container is again in the unsealed and ready to open state. The upward pivotal movement of the handle 12 drives the gear portions 131 arranged at both ends thereof to rotate toward the pivotal side 162 of the lid, so that the right one of the three pinions 1314 shown in FIG. 15 engages with the gear rack 132 arranged on the flange 184 of the container body 18 (see FIG. 10B), which in turn causes the lid 16 to move transversely in the direction toward the pivotal side 162 thereof. This transverse movement of the lid 16 results in movement of the bulge 1641 of the lid away from the protrusion 185 of the container body until the lid cam surface 1642 of the bulge 1641 is disengaged from the body cam surface 1852 of the protrusion 185 (see FIG. 12B), and the lid 16 is in the release position. Under the condition that the lid cam surface 1642 is disengageable from the body cam surface 1852, the seal element in the annular groove 161 of the lid 16 is not biased and becomes loose and unpressed. At the same time, each of the two pivotal points 1653 of the downwardly extending portion 165 of the lid 16 moves within the slot 1871 of the lugs 187 of the container body 18 to the distal end 1874 of the slot 1871 (see FIG. 11B). In addition, the hook element 1691 of the tab 169 of the lid moves simultaneously in the through hole 1841 of the container body 18 in the direction away from the container body 18 and disengages from the step 1842 (see FIG. 13B). Under the circumstance where the seal element is loose and unpressed and the relevant parts are unlocked and disengaged, the lid 16 can pivot upwardly with respect to the container body 18 with ease to expose the open top of the container body and to remove the lid 16 from the container body 18.

The lugs 187, the protrusions 185, and the through holes 1841 of the container body 18 as well as the downwardly extending portions 165, the bulges 1641, and the hook elements 1691 of the lid 16 are configured and positioned to cooperate with the gear rack and pinion mechanism functioned as the actuating apparatus. The user can easily and quickly seal the storage container or release the lid to store and access the items in the container body.

Figure 16:
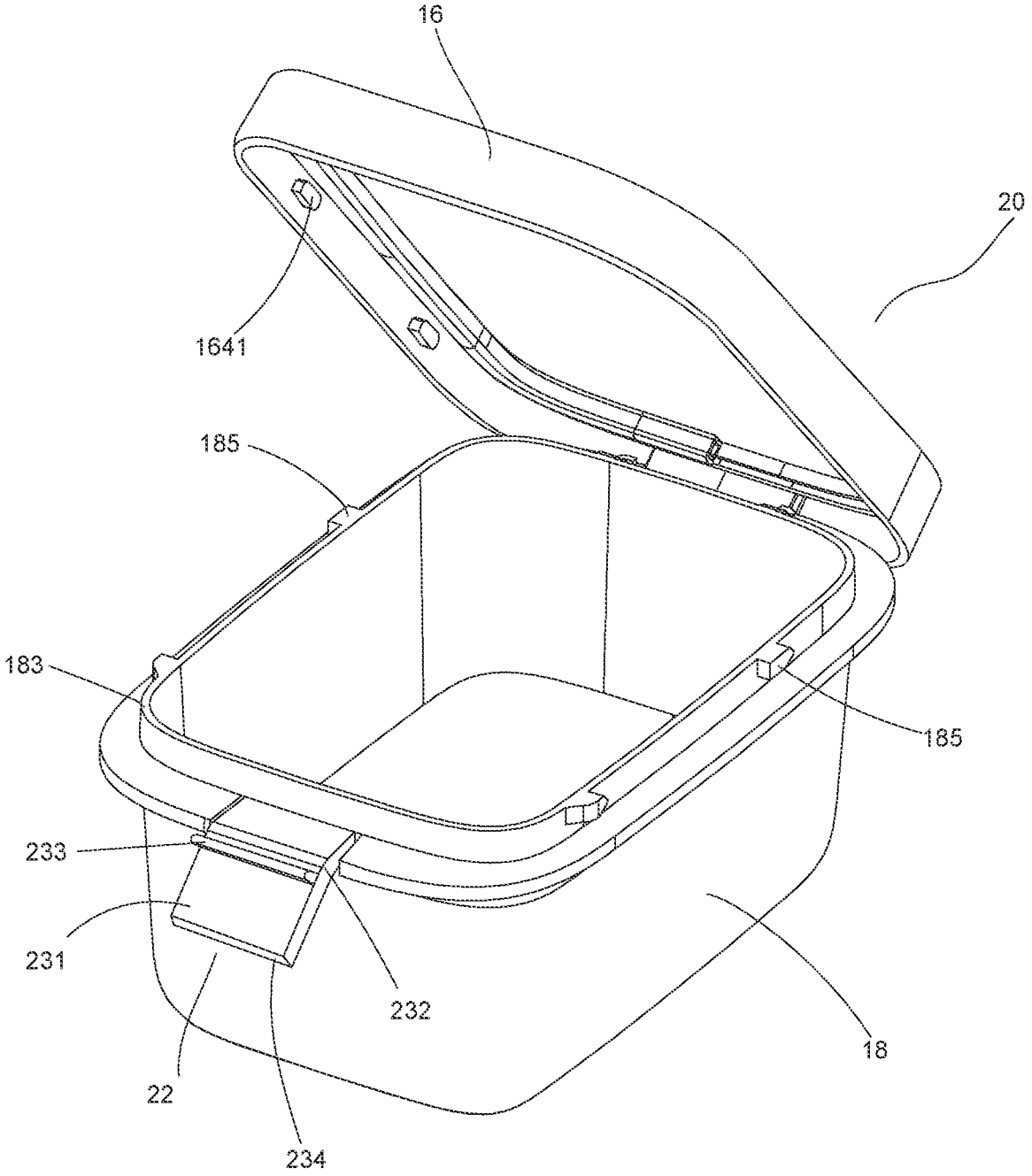
FIG. 16 is a perspective view of a storage container constructed according to a second embodiment of the present invention, wherein the container is in an open state.
Figure 17:
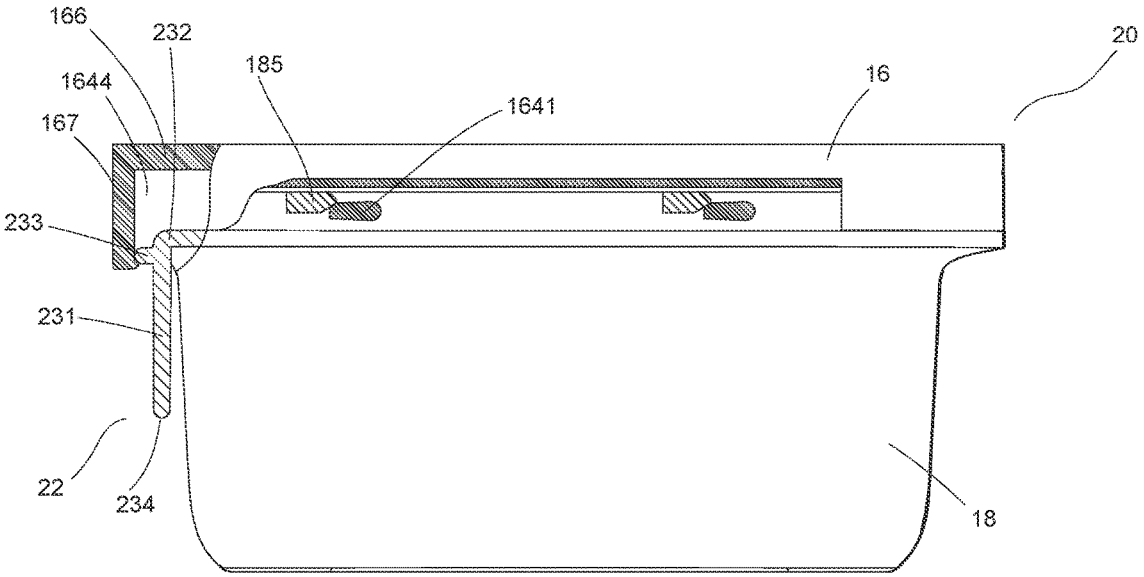
FIG. 17 is a schematic view of the storage container shown in FIG. 16 in a hermetically closed state.
Figure 18:
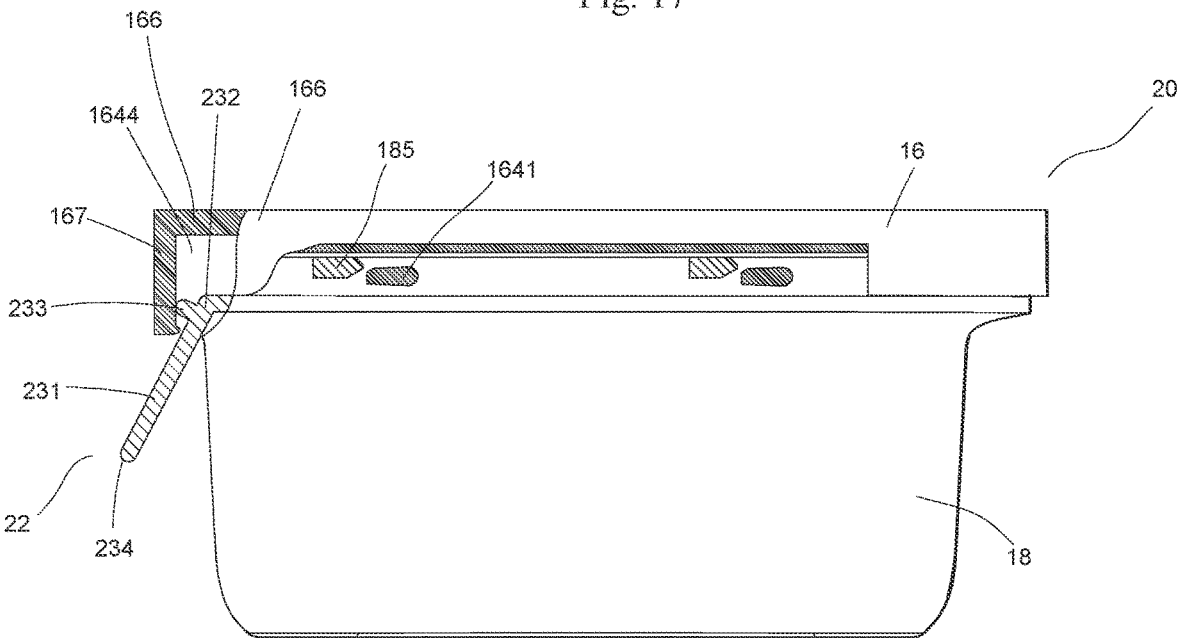
FIG. 18 is a schematic view of the storage container shown in FIG. 16 in a ready to open state.

FIGS. 16 to 18 show a storage container 20 constructed according to a second embodiment of the present invention. The storage container 20 of this embodiment is substantially structurally same as the storage container 10 of the first embodiment, but differs in the actuating apparatus for actuating the lid to move between the closed position and the release position. The actuating apparatus of this second embodiment is configured as configured a locking flap 22 foldably or pivotably connected to the container body, instead of the gear rack and pinion mechanism adopted in the first embodiment. The locking flap 22 is foldably or pivotably connected to a top edge 183 of one side wall of the container body 18, said side wall being positioned to correspond to the implementing side 163 of the lid, as shown in FIG. 16. The locking flap 22 comprises an manipulation portion 231 having a first end portion 232 and a second end 234. The first end portion 232 is foldably or pivotably connected to the top edge 183 of the container body 18, and is provided with a snap-fit projection 233. The second end 234 is a free end for the user to manipulate. The plate-shaped portion 166 of the lid and a portion of the outer lip 167 together define a snap-fit groove 1644 engageable with the snap-fit projection 233. Specifically, the second end 234 of the locking flap 22 is folded or pivots downwardly to cause the lid 16 to move transversely in the direction toward the implementing side 163 thereof, so that the snap-fit projection 233 is engaged with the snap-fit groove 1644 (see FIG. 17), where the locking flap 22 is locked in its locked position. As discussed above in the first embodiment, this transverse movement of the lid 16 results in the movement of the bulge 1641 of the lid toward the protrusion 185 of the container body until the lid cam surface 1642 of the bulge 1641 is brought into abutment on and engages with the body cam surface 1852 of the protrusion 185 to lock the lid 16 in the closed position. The second end 234 of the locking flap is folded or pivots upwardly to cause the lid 16 to move transversely in the direction toward the pivotal side 162 thereof, so that the snap-fit projection 233 is disengaged from the snap-fit groove 1644 (see FIG. 18), where the locking flap 22 is in its unlocked position. As discussed above in the first embodiment, this transverse movement of the lid 16 results in the movement of the bulge 1641 of the lid away from the protrusion 185 of the container body until the lid cam surface 1642 of the bulge 1641 is disengaged from the body cam surface 1852 of the protrusion 185, and the lid 16 is released into the release position.

Figure 19:
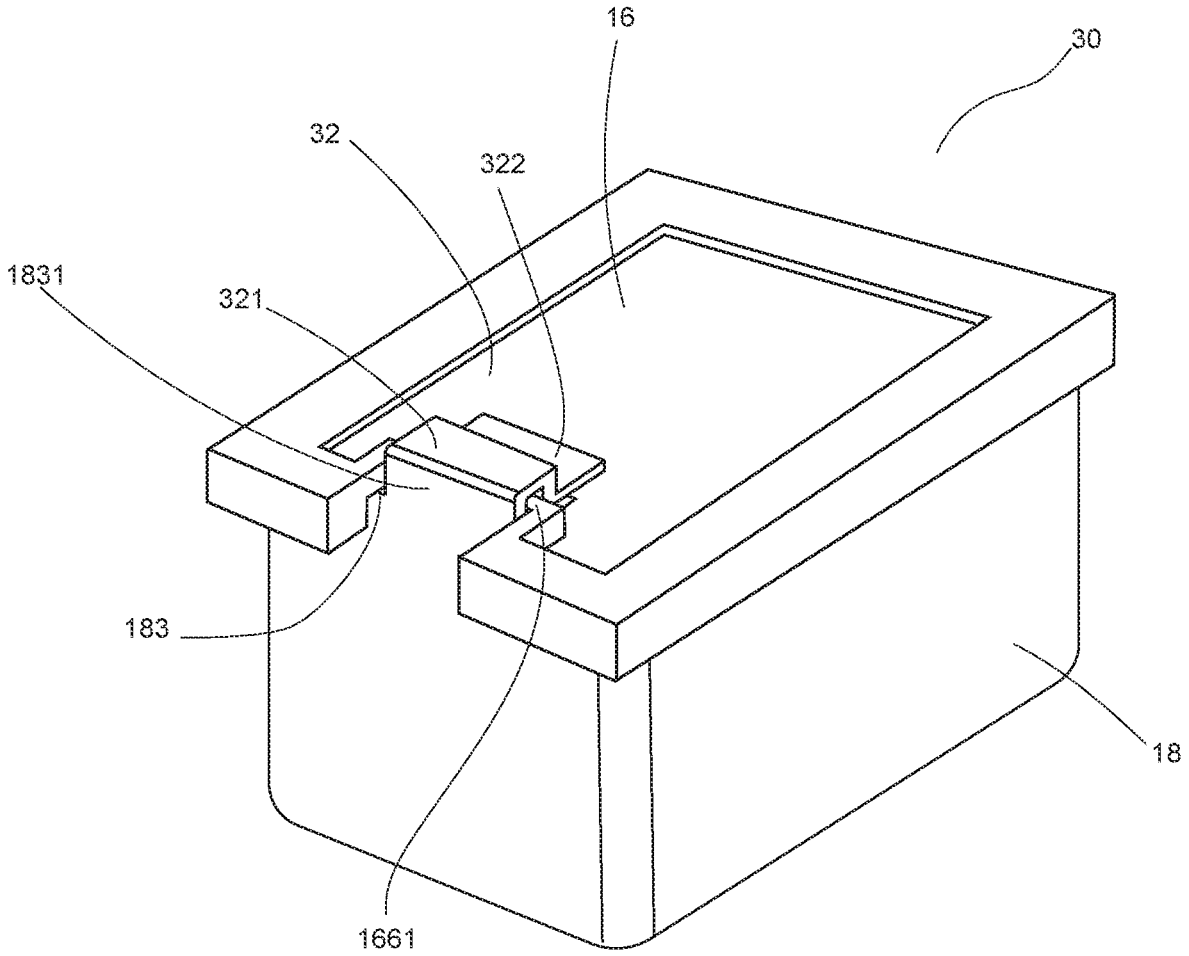
FIG. 19 is a perspective view of a storage container constructed according to a third embodiment of the present invention, wherein the container is in an closed state.
Figure 20:
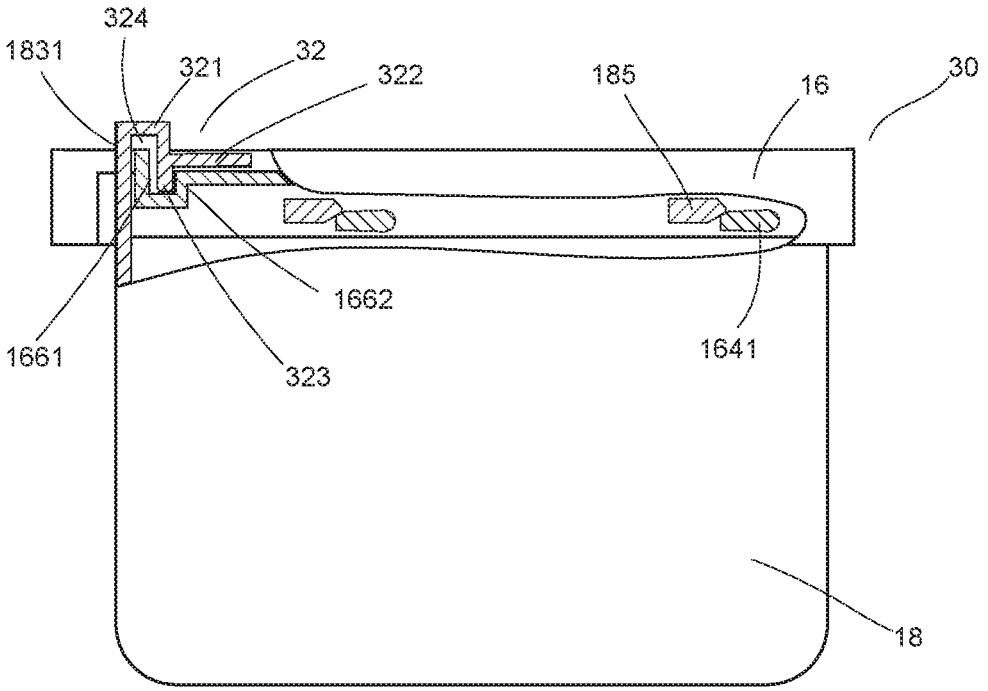
FIG. 20 is a schematic view of the storage container shown in FIG. 19 in a hermetically closed state.
Figure 21:
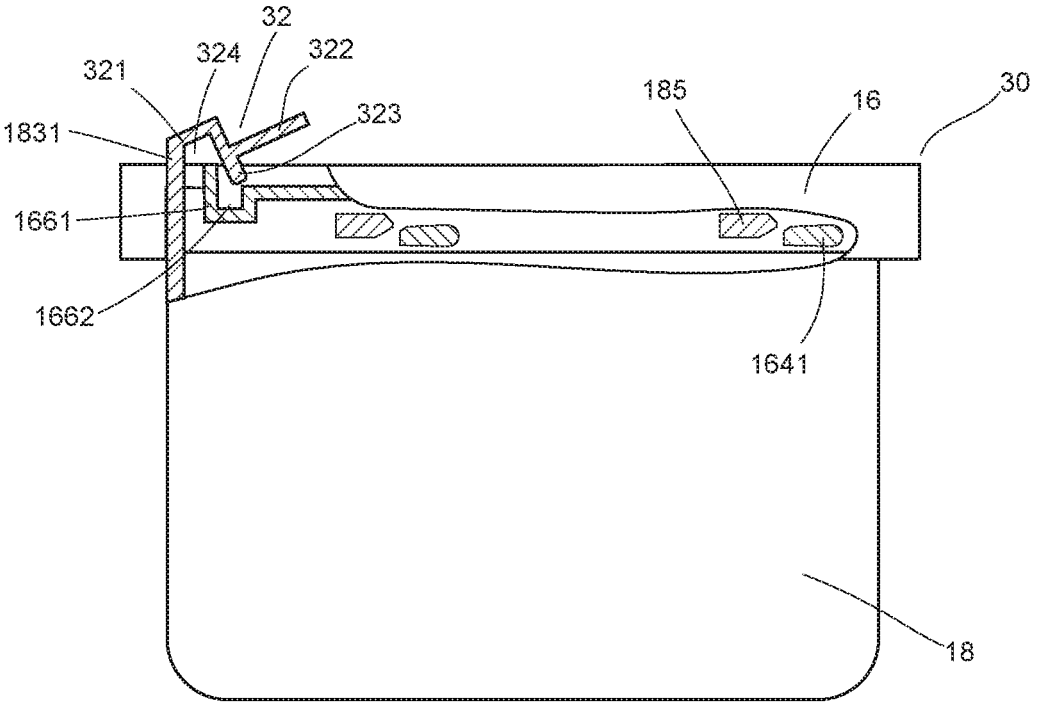
FIG. 21 is a schematic view of the storage container shown in FIG. 19 in a ready to open state.

FIGS. 19 to 21 show a storage container 30 constructed according to a third embodiment of the present invention. The storage container 30 of this embodiment is substantially structurally same as the storage container 20 of the second embodiment, but differs in a locking flap 32 foldably or pivotably connected to a connecting portion 1831 extending upwardly from the top edge 183 of the container body 18, and also in the implementing side 163 of the lid 16 comprising an inwardly recessed portion 1661, as shown in FIGS. 20 and 21. The locking flap 32 comprises a plate-shaped element 321 and a L-shaped element 322 extending downwardly from the plate-shaped element 321. The plate-shaped element 321, the L-shaped element 322, and the connecting portion 1831 together form a channel 324 to receive the above-mentioned inwardly recessed portion 1661 of lid. The locking flap 32 further comprises a snap-fit projection 323 extending downwardly from the underside of the L-shaped element, and the snap-fit projection 323 is configured to operatively cooperate with a snap-fit groove 1662 formed on the plate-shaped portion of the lid. Like the locking flap 22 of the second embodiment, the locking flap 32 of this embodiment is folded or pivots downwardly, with the L-shaped element 322 movable to come into contact with the inwardly recessed portion 1661 of the lid, thereby causing the lid 16 to move transversely in the direction toward the implementing side 163 until the snap-fit projection 323 engages with the snap-fit groove 1662 (see FIG. 20) to loke the locking flap 32 in its locked position. As discussed in the above first embodiment, this transverse movement of the lid 16 results in the movement of the bulge 1641 of the lid toward the protrusion 185 of the container body until the lid cam surface 1642 of the bulge 1641 is brought into abutment on and engages with the body cam surface 1852 of the protrusion 185 to lock the lid 16 in the closed position. When the locking flap 32 is folded or pivots upwardly, the L-shaped element 322 is caused to come into contact with one side of the snap-fit groove 1662 of the lid to urge the lid 16 to move transversely in the direction toward the pivotal side 162 thereof, and finally disengage the snap-fit projection 323 from the snap-fit groove 1662 (see FIG. 21), and the locking flap 32 moves to its unlocked position. This transverse movement of the lid 16 results in the movement of the bulge 1641 of the lid away from the protrusion 185 of the container body until the lid cam surface 1642 of the bulge 1641 is disengaged from the body cam surface 1852 of the protrusion 185, and the lid 16 is released into the release position.

Various embodiments of the present invention having lids and container bodies of specific sizes and shapes are described. However, it should be understood that the lids and container bodies may also have any suitable sizes and/or shapes to accommodate different storage items.

Therefore, the present invention provides a storage container having a lid and a container body which have complementarily interfitting elements. The actuating apparatuses in different forms discussed above work together with the complementarily interfitting elements to actuate the opening and hermetical closing of the container, which allows the user to open and close the container with ease, rendering the operation simple and effortless.

Although the present invention is described in terms of what is currently considered to be the most practical and preferred embodiment, it should be understood that the present invention is not limited to the disclosed embodiments, and the present invention is intended to comprise various modifications and equivalent structures included within the spirit and protection scope of the claims. The present invention may be modified and changed without departing from the novel aspects of the invention as defined in the claims, and the application is limited only by the scope of protection of the claims.

DRAWINGS REFERENCES

10, 20, 30 Storage container
12 Handle
121 Grasping piece
122 End of the handle
123 Pivot
131 Gear portion
1312 Base of the gear portion
1314 Pinion
132 Gear rack
14 Side rim
142 End of the side rim
16 Lid
161 Annular groove
162 Pivotal side of the lid
163 Implementing side of the lid
164 Neck portion of the lid
1641 Bulge
1642 Lid cam surface
1643 Cutout
1644 Snap-fit groove
165 Downwardly extending portion of the lid
1651 Upright element
1652 Transverse element
1653 Pivotal point
166 Plate-shaped portion of the lid
1661 Inwardly recessed portion of the lid
1662 Snap-fit groove
167 Outer lip of the lid
168 Inner lip of the lid
169 Tab of the lid
1691 Hook element
18 Container body
181 Bottom of the container body
182 Side wall of the container body

183 Top edge of the container body
1831 Connecting portion
184 Flange
1841 Through hole
1842 Step of through hole
185 Protrusion
1852 Body cam surface
186 Guiding protrusion
187 Lug
1871 Lug slot
1872 Horizontal slot portion of the lug slot
1873 Vertical slot portion of the lug slot
1874 Distal end of the horizontal slot portion
1875 Proximal end of the horizontal slot portion
22, 32 Locking flap
231 Manipulation portion
232 First end portion of the manipulation portion
234 Second end of the manipulation portion
233, 323 Snap-fit projection
321 Plate-shaped element
322 L-shaped element
324 Channel

What is claimed is:

1. A storage container includes:

a container body having a bottom, a side wall extending upwardly from the bottom, an internal storage space surrounded by the side wall, a top edge and an open top defined by the top edge, a lid placed on the container body for opening and closing the open top, comprising a plate-shaped portion and a neck portion extending downwardly from at least a part of opposite sides of the plate-shaped portion, and an actuating apparatus configured to actuate the lid to move between a closed position where the storage container is closed and a release position where the storage container is ready to open, characterized in that, one or more body cam surfaces are arranged on an outer surface of the side wall of the container body at one or more positions adjacent to the open top, and one or more lid cam surfaces are arranged on an inner side surface of the neck portion of the lid in such a manner that the lid cam surfaces are configured to oppose the body cam surfaces respectively, the lid is locked in the closed position by moving the lid in a first direction so as to bring the lid cam surfaces into abutment on and engage with the body cam surfaces, and the lid is moved to the release position by moving the lid in a second direction so as to disengage the lid cam surfaces from the body cam surface, and the storage container further comprises a handle having a pivot through which the handle is pivotally mounted on the lid, and the actuating apparatus is configured as a gear rack and pinion mechanism, the gear rack and pinion mechanism comprising:

a gear rack arranged on a flange of the side wall of the container body, and at least one gear portion engageable with the gear rack, wherein the gear portion is connected to the pivot of the handle and defines a plurality of pinions, wherein pivotal movement of the handle relative to the lid drives the gear portion to rotate so that the plurality of pinions alternately engage with the gear rack, thereby moving the lid to cause the lid cam surfaces to engage with or disengage from the respective body cam surfaces.

2. The storage container according to claim 1, characterized in that the gear portion comprises a base, the base comprising a plate element having a first end which extends transversely from the pivot of the handle, and a second end from which the plurality of pinions extend downwardly.

3. The storage container according to claim 2, characterized in that the neck portion of the lid comprise a cutout to allow passage of the pivot of the handle therethrough, the pivot being held pivotally in place.

4. The storage container according to claim 1, characterized in that the container body further comprises one or more guiding protrusions on a same side of the body cam surfaces to guide positioning of the lid relative to the container body and guide the lid to move between the closed position and the release position.

5. The storage container according to claim 1, characterized in that the lid has a pivotal side detachably pivotal on the container body and an implementing side opposite to the pivotal side.

6. The storage container according to claim 5, characterized in that the pivotal side of the lid comprises a downwardly extending portion having an inverted T shape, the downwardly extending portion comprising an upright element and a transverse element transversely extending from the upright element, wherein a pivotal point forms outwardly at each of two opposite ends of the transverse element; and two lugs in spaced-apart fashion are formed on one side wall of the container body, each lug having a slot therein, wherein the two lugs are positioned such that the two pivotal points of the downwardly extending portion are movably received in the respective slots.

7. The storage container according to claim 6, characterized in that the slot is L-shaped, comprising a horizontal slot portion and a vertical slot portion, and the pivotal point is movable in the horizontal slot portion between a distal end in communication with the vertical slot portion and a proximal end away from the vertical slot portion, and wherein the lid is detachable from the container body when the pivotal point is positioned at the distal end, and locked to the container body to close the open top when the pivotal point is positioned at the proximal end.

8. The storage container according to claim 5, characterized in that one or more tabs, spaced-apart from each other, extending downwardly from the lid are provided on the implementing side of the lid, each of the tabs having a hook member at a free end thereof, and wherein a flange is formed on the side wall of the container body, and one or more through holes are positioned on the flange, the through holes being sized and positioned so that the respective tabs are detachably and movably received in the through holes, or vice versa, that is, one or more of the through holes are formed on the implementing side of the lid, and one or more of the tabs are provided on the side wall of the container body.

9. The storage container according to claim 8, characterized in that the through hole is provided as a stepped hole for engagement with the hook member when it moves in the stepped hole to a position away from the container body so as to lock the lid in the closed position, and the hook member disengages from the stepped hole when it moves in the stepped hole to a position adjacent to the container body so as to render the lid in the release position.

10. The storage container according to claim 5, characterized in that the handle is configured to rest on the implementing side of the lid in the closed position, and the pivotal side of the lid is provided with a side rim surrounding the pivotal side, wherein the side rim and the handle are structured and sized to be complementary to each other in a manner that they form together an annular ring that snaps fit into an outer circumferential edge of the lid.

11. The storage container according to claim 1, characterized in that the storage container further comprises a seal element arranged in an annular groove of the lid, and wherein the lid cam surfaces are brought into abutment on and engagement with the body cam surfaces to bias the seal element against the inner wall of the container body, thereby creating a seal between the container body and the lid, and the seal element is released when the lid cam surfaces are disengaged from the body cam surfaces.

12. The storage container according to claim 1, characterized in that the storage container further comprises a seal element arranged in an annular groove of the lid, and wherein the lid cam surfaces are brought into abutment on and engagement with the body cam surfaces to bias the seal element against the inner wall of the container body, thereby creating a seal between the container body and the lid, and the seal element is released when the lid cam surfaces are disengaged from the body cam surfaces.

13. The storage container according to claim 1, characterized in that the lid has a pivotal side detachably pivotal on the container body and an implementing side opposite to the pivotal side.

14. The storage container according to claim 13, characterized in that the pivotal side of the lid comprises a downwardly extending portion having an inverted T shape, the downwardly extending portion comprising an upright element and a transverse element transversely extending from the upright element, wherein a pivotal point forms outwardly at each of two opposite ends of the transverse element; and two lugs in spaced-apart fashion are formed on one side wall of the container body, each lug having a slot therein, wherein the two lugs are positioned such that the two pivotal points of the downwardly extending portion are movably received in the respective slots.

15. The storage container according to claim 14, characterized in that the slot is L-shaped, comprising a horizontal slot portion and a vertical slot portion, and the pivotal point is movable in the horizontal slot portion between a distal end in communication with the vertical slot portion and a proximal end away from the vertical slot portion, and wherein the lid is detachable from the container body when the pivotal point is positioned at the distal end, and locked to the container body to close the open top when the pivotal point is positioned at the proximal end.

* * * * *